United States Patent [19]

Kurosaki

[11] Patent Number: 5,035,455

[45] Date of Patent: Jul. 30, 1991

[54] LOCK DEVICE FOR CASES

[75] Inventor: Mutsuo Kurosaki, Yokohama, Japan

[73] Assignee: Nifco, Inc., Yokohama, Japan

[21] Appl. No.: 550,268

[22] Filed: Jul. 9, 1990

[51] Int. Cl.[5] ..... E05C 21/00

[52] U.S. Cl. ..... 292/341.17; 292/201; 292/DIG. 56; 292/DIG. 58

[58] Field of Search ..... 70/69-76, 70/12, 436; 49/9; 292/341.17, DIG. 48, DIG. 56, DIG. 58, 103, 204, 341.12, 201; 188/306

[56] References Cited

U.S. PATENT DOCUMENTS

| | | | |
|---|---|---|---|
| 1,004,716 | 10/1911 | Voight | 292/341.12 |
| 2,851,296 | 9/1958 | Guyaz | 292/341.17 X |
| 4,653,141 | 3/1987 | Converse | 188/306 X |
| 4,893,700 | 1/1990 | Gramss | 188/306 |

*Primary Examiner*—Richard E. Moore

*Attorney, Agent, or Firm*—Schwartz & Weinrieb

[57] ABSTRACT

A lock device for a case having a body and a lid includes a latch member, a lock member, a lock-releasing mechanism and a damper. The latch member is pivotably mounted upon one of the body and lid components of the case and normally biased in the unlocking direction. The lock member is mounted upon the other one of the body and lid components of the case for releasably receiving and locking the latch member when the body is in the state of being closed by means of the lid and for retaining the locked state of the latch member. The lock-releasing mechanism is provided upon the lock member for unlocking the lock member. The damper is engaged with the latch member for damping the movement of the latch member under the influence of the biasing force in the unlocking direction of the latch member.

11 Claims, 3 Drawing Sheets

LOCK DEVICE FOR CASES

BACKGROUND OF THE INVENTION

The present invention relates the movement of the latch member under the influence of to a lock device for an attache case, a suitcase or other such case.

DESCRIPTION OF THE PRIOR ART

Attache cases available on the market comprise a case body, a lid for closing the case body, a handle for carrying the attache case, and a pair of lock devices disposed upon opposite sides of the handle. The conventional lock device includes a latch member pivotably mounted upon the lid by means of a hinge and normally biased in the unlocking direction, a lock member mounted upon the case body for releasably receiving and locking the latch member upon the case body in the state that the case body of closed by the means of the lid and for retaining the locked state of the latch member, and a lock-releasing mechanism mounted upon the case body for unlocking the lock member.

Illustrated in FIG. 6 is a prior art latch member 1 which is pivotably mounted by means of a pivot pin 4 upon a pair of brackets 3 projecting from a base plate 2 which is to be fixed to the lid of an attache case by means of rivets. The latch member 1 has its base end engaged with one end of a coil spring 5 wound upon a portion of the pivot pin 4 which is interposed between the brackets 3 so that the latch member 1 is normally biased in a direction causing it to move upwardly, that is in the unlocking direction.

When the latch member 1 is pivoted by means of one's finger tip in the locking direction against the biasing force of the coil spring 5, while the lid is maintained closed, a substantially U-shaped striker 1*a* provided upon the free end of the latch member 1 is engaged with a lock member (not shown) mounted upon the case body of the attache case so as to retain the lid in a locked state relative to the case body.

The striker 1*a* thus engaged with the lock member can be disengaged from the lock member by operating a lock-releasing button provided upon the lock member. This operation results in a quick pivotable movement of the latch member 1 in the unlocking direction as a result of the biasing force of the spring 5. Consequently, the lid may be opened relative to the case body.

The prior art lock device having the construction as described above suffers from the following problems. At the time of releasing the latch mechanism from the locked state, the latch member is pivoted quickly and collides against a stepped portion formed upon the back side of the bracket 3 with a loud noise. The noise generated by means of the latch every time the locked state is released is undesirable. In addition, there is a possibility that the user will experience pain as a result of an accidental impact of the quickly pivotable latch member upon his or her figers. Furthermore, since latch members of this kind are generally produced by forging and need only be large enough to be easily manipulated by the user's hands, they are liable to break under the aforementioned repeated collision with the stepped portion of the bracket. These repeated collisions will also lower the service life of the coil spring 5.

OBJECTS OF THE INVENTION

The present invention has been accomplished in orde to solve the aforementioned problems.

The main object of the present invention is to provide a lock device for a case which prevents a latch member from generally to lock devices, and more particularly to prevent breakage of the latch member and the generation of noise.

SUMMARY OF THE INVENTION

In order to attain the object described above, according to the present invention there is provided a lock device for a case having a body and a lid which comprises a latch member pivotably mounted upon either one of the body or the lid of the case and normally biased in the unlocking direction, a lock member mounted upon the other one of the body and the lid for releasably receiving and locking the latch member when the body is in the state that the same is closed by means of the lid and for retaining the locked state of the latch member, a lock-releasing mechanism provided upon the lock member for unlocking the lock member, and damper means engaged with the latch member for damping the biasing force in the unlocking direction of the latch member.

With the lock device according to the present invention, since the biasing force exerted upon the latch member in the unlocking direction is damped by means of the damper means, the latch member is pivoted slowly in the unlocking direction so as to prevent the breakage of the lock device and the generation of noise as exhibited by means of the prior art lock devices due to the quick pivotable movement of the latch member in the unlocking direction.

BRIEF DESCRIPTION OF THE DRAWINGS

The above and other objects, characteristic features and advantages of the present invention will become more apparent to those skilled in the art as the disclosure of the present invention is made hereinbelow with reference to the accompanying drawings quickly pivoting immediately prior to the opening of the case lid so as.

DETAILED DESCRIPTION OF THE PREFERRED EMBODIMENT

FIG. 1 to FIG. 5 illustrate one embodiment of the lock device constructed according to the present invention.

Figure 1:
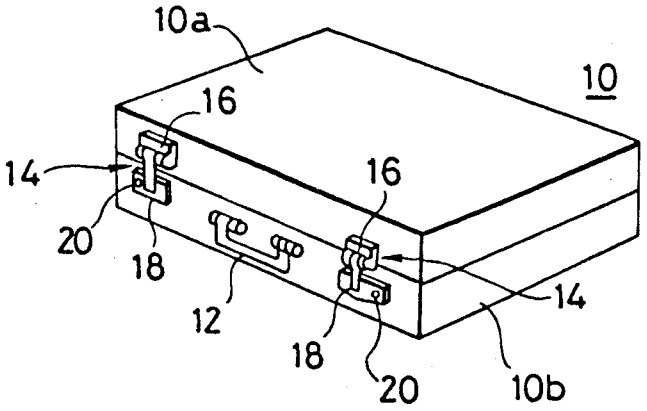
FIG. 1 is a perspective view illustrating an attache case equipped with one embodiment of the lock device constructed according to the present invention.
Figure 2:
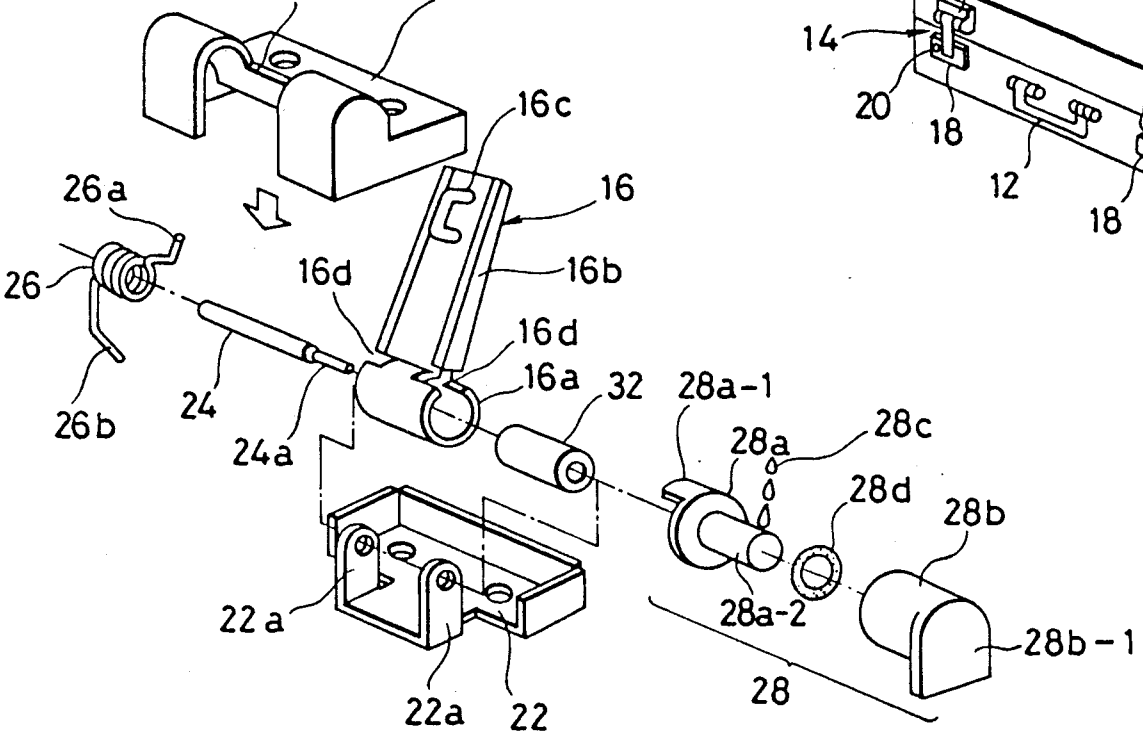
FIG. 2 is an exploded perspective view illustrating the latch member assembly of the lock device of the present invention.

As illustrated in FIG. 1, a pair of lock devices 14 are provided upon opposite sides of a handle 12 of an attache case 10 comprising a case body 10*b* and a lid 10*a*. Each of the lock devices 14 comprises a latch member 16 mounted upon the lid 10*a*, a lock member 18 mounted upon the case body 10*b*, and a lock-releasing button 20 provided upon the lock member 18.

Figure 3:
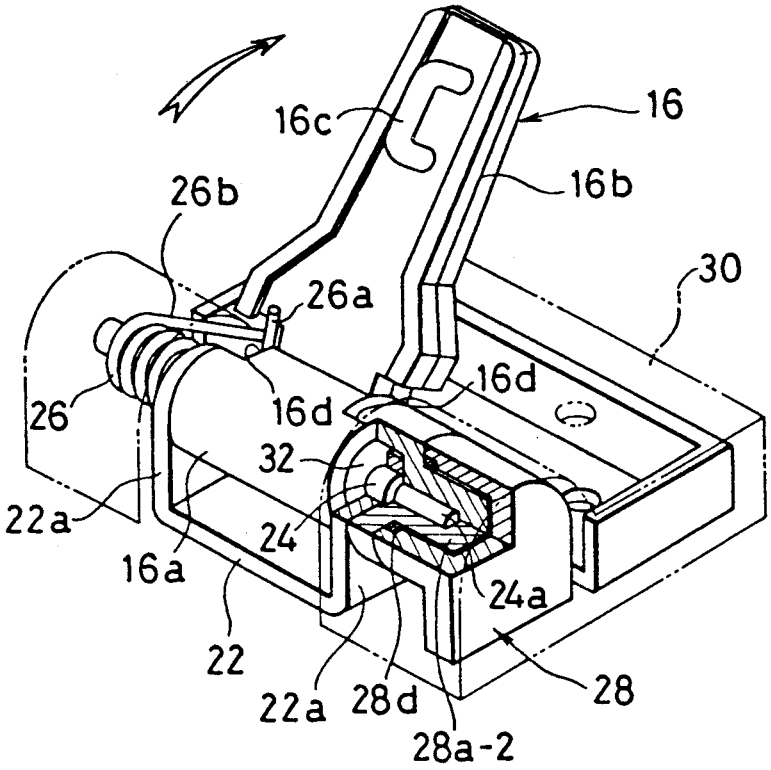
FIG. 3 is a partially sectioned perspective view illustrating the assembly of FIG. 2.
Figure 4:
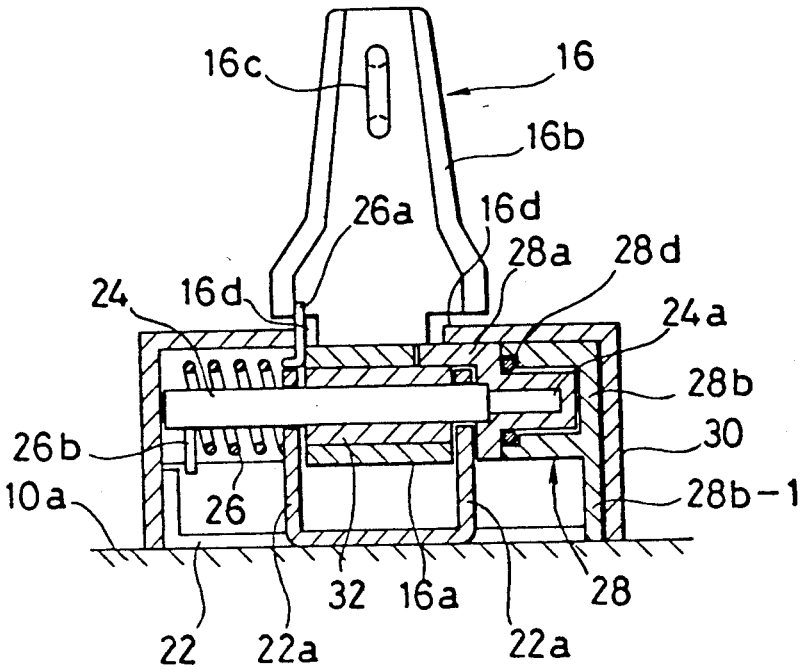
FIG. 4 is a longitudinal cross section illustrating the assembly of FIG. 3.
Figure 5:
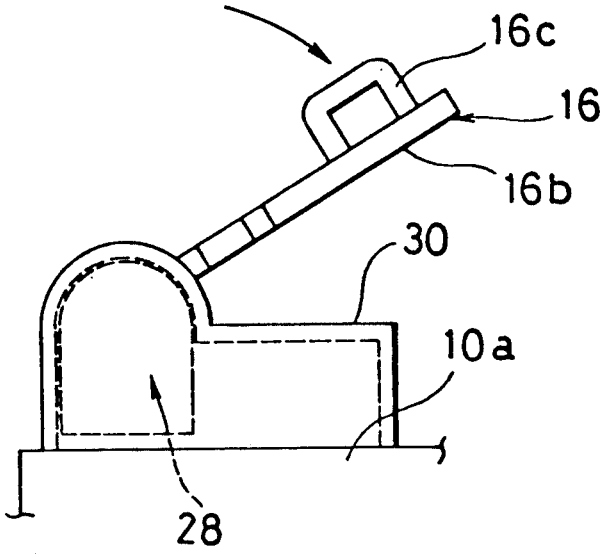
FIG. 5 is a side view illustrating the assembly of FIG. 3.
Figure 6:
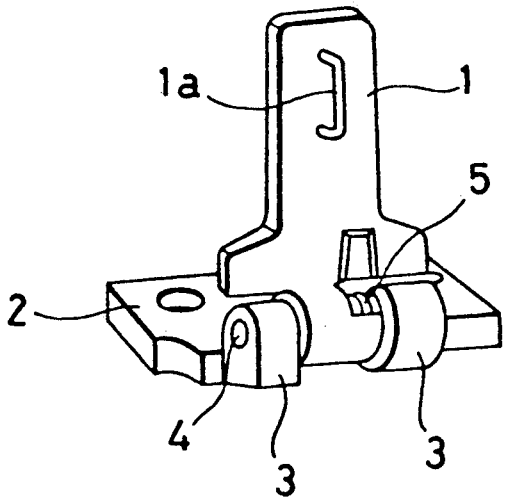
FIG. 6 PRIOR ART
FIG. 6 is a perspective view illustrating a prior art latch member.

As illustrated in FIGS. 2 to 5, the latch member 16 is pivotably supported by means of a pivot pin 24, the ends of which are mounted within a pair of brackets 22*a* integral with the front end of a base plate 22 which is formed by means of a pressing operation. A coil spring 26 for biasing the latch member 16 in the unlocking direction is wound upon a portion of the pivot pin 24 disposed upon the side of one of the brackets 22*a*, and an oil damper 28 is disposed upon the side of the other one of the brackets 22*a*. The base plate 22, coil spring 26 and oil damper 28 are covered by means of a cover member 30 having a central notch 30*a* formed within the front end thereof for allowing the latch member 16 to project outwardly therefrom and concurrently serving as a stopper for the latch member 16 when the latter is disposed at its fully released position with respect to the lock member 18 and the lid 10*a* . As shown in FIGS. 3 to 5, an assembly consisting of the base plate 22, latch member 16, coil spring 26, oil damper 28 and cover member 30 is mounted upon the lid 10*a* of the attache case 10 by securing the base plate 22 to the lid 10*a* by means of rivets or other such fastening means (not shown).

To be specific, the latch member 16 is formed by means of a forging operation and comprises a cylindrical hollow portion 16*a* for accommodating a cylindrical hollow spacer 32 through which the pivot pin 24 is disposed, a body portion 16*b* integrally extending outwardly from the periphery of the cylindrical hollow portion 16*a*, and a substantially U-shaped striker 16*c* integrally formed upon the free end of the body portion 16*b*. Slits 16*d* are formed upon opposite sides of the integral connection portion defined between the cylindrical hollow portion 16*a* and the body portion 16*b*.

The coil spring 26 wound upon the pivot 24 has one end 26*a* thereof accommodated within one slit 16*d* so as to abut the body portion 16*b* of the latch member 16 and the other end 26*b* abuts a vertical wall of the base plate 22, thereby normally biasing the latch member 16 in the unlocking direction.

The oil damper 28 is of a very small size and comprises a rotor 28*a* which accomodates an extension 24*a* of the pivot pin 24 and which has an engaging projection 28*a*-1 formed integrally with its pivoting end so as to be acommodated within the other slit 16*d*, a housing 28*b* pivotably accommodating a rotary shaft 28*a*-2 of the rotor 28*a* and having a pivot-preventing projection 28*b*-1 formed integrally with its rear end so as to rest upon the lid 10*a* of the attache case 10, a viscous oil 28*c* such as, for example, silicone oil interposed between the outer surface of the rotary shaft 28*a*-2 of the rotar 28*a* and the inner surface of the housing 28*b*, and an o-ring 28*d* disposed about the inner circumference of the open end of the housing 28*b* for sealing the viscous oil 28*c* between the rotor 28*a* and the housing 28*b*.

In the construction described above, when the lock-releasing button is operated while the latch member 16 is disposed in its locked state, the striker 16*c* is disengage from the lock member 18. As a result, the latch member 16 is pivoted rotated in the unlocking direction by means of the biasing force of the coil spring 26, and the rotor 28*a* of the damper is simultaneously pivoted as a result of the engagement between the engaging projection 28*a*-1 of the rotor 28*a* and the slit 16*d* of the latch member 16. For this reason, the latch member 16 is not pivoted quickly but slowly as a result of the resistance of the viscous oil 28*c* interposed between the rotary shaft 28*a*-2 and the housing 28*b* and the pivotable movement of the latch member 16 is stopped when the rear surface of the latch member 16 collides against the edge of the central notch 30*a* of the cover member 30. The oil damper 28 is used in the illustrated embodiment but a piston-cylinder type air damper may be used instead.

As described above, according to the present invention it is possible to slowly pivot the latch member in the unlocking direction, thereby preventing the generation of noise and the accidental collision of the latch member against the user's fingers, as well as avoiding damage to the latch member and coil spring. Furthermore, according to the present invention it is possible to bring about the damping effect without changing the fundamental construction of existing lock devices to a great extent.

Obviously, many modifications and variations of the present invention are possible in light of the above teachings. It is therefore to be understood that within the scope of the appended claims, the present invention may be practiced otherwise than as specifically described herein.

What is claimed is:

1. A lock device for a case having a body and a lid, comprising:

a latch member pivotably mounted upon one of said body and said lid of said case about a predetermined axis, and including a receiving means defined thereon;

means engaged directly with said latch member for biasing said latch member in an unlocking direction about said axis;

a lock member mounted upon the other one of said body and said lid for releasably receiving and locking said latch member when said body is closed by said lid and for retaining the locked state of said latch member;

a lock-releasing mechanism provided upon said lock member for unlocking said lock member; and damper means, having projecting means mounted thereon, directly engaged with said latch member, a a result of said projecting means of said damper means being received within said receiving means of said latch member, for damping the biasing force of said biasing means in said unlocking direction of said latch member as said latch member pivots about said axis in said unlocking direction under the influence of said biasing force of said biasing means.

2. A lock device according to claim 1, wherein said damper means comprises a rotor engaged with said latch member, a housing for rotatably housing said rotor, and a viscous oil interposed between said rotor and said housing.

3. A lock device as set forth in claim 1, wherein:

said case comprises an attache case.

4. A lock device as set forth in claim 3, wherein:

said attache case comprises a handle mounted upon one side surface of said case, and a pair of lock devices disposed upon opposite sides of said handle.

5. A lock device as set forth in claim 1, wherein:

said latch member is disposed upon said case lid; and said lock member is disposed upon said body of said case.

6. A lock device as set forth in claim 1, wherein:

said biasing means comprises a coil spring.

7. A lock device as set forth in claim 2, wherein:

said biasing means is disposed within one end portion of said housing, said damper rotor is disposed within another end portion of said housing, and said latch member is disposed within a central portion of said housing.

8. A lock device as set forth in claim 2, wherein:

said latch member comprises a cylindrical tubular portion pivotably mounted within said housing, and a body portion integrally formed with and projecting radially outwardly from an outer peripheral surface portion of said cylindrical tubular portion.

9. A lock device as set forth in claim 8, wherein:

said receiving means of said latch member comprises an axially extending notch defined within a peipheral wall portion of said cylindrical tubular portion of said latch member; and said projecting means of said damper means comprises an axially projecting finger integrally formed upon said rotor.

10. A lock device as set forth in claim 8, wherein:

said cylindrical tubular portion of said latch member includes slit means for receiving one end of said biasing means such that said biasing means is directly engaged with said latch member.

11. A lock device as set forth in claim 2, wherein:

said viscous oil comprises a silicone oil.

* * * * *